US007824248B2

(12) United States Patent
Treffner

(10) Patent No.: US 7,824,248 B2
(45) Date of Patent: Nov. 2, 2010

(54) WHEEL ASSEMBLY FOR A PNEUMATIC SANDER

(76) Inventor: Peter P. Treffner, 3 Lasburn Crescent, Carlingford, NSW (AU) 2118

( * ) Notice: Subject to any disclaimer, the term of this patent is extended or adjusted under 35 U.S.C. 154(b) by 378 days.

(21) Appl. No.: 10/572,326

(22) PCT Filed: Sep. 17, 2004

(86) PCT No.: PCT/AU2004/001269

§ 371 (c)(1),
(2), (4) Date: Feb. 15, 2007

(87) PCT Pub. No.: WO2005/028158

PCT Pub. Date: Mar. 31, 2005

(65) Prior Publication Data

US 2007/0281595 A1 Dec. 6, 2007

(30) Foreign Application Priority Data

Sep. 19, 2003 (AU) ..... 2003905140

(51) Int. Cl.
*B24D 9/02* (2006.01)

(52) U.S. Cl. ..... 451/495; 451/505

(58) Field of Classification Search ..... 451/490, 451/495, 504–505

See application file for complete search history.

(56) References Cited

U.S. PATENT DOCUMENTS 2,017,163 A * 10/1935 Reed ..... 451/505
2,505,680 A * 4/1950 Mall ..... 451/505
2,601,048 A * 6/1952 Monger ..... 451/505
2,645,087 A * 7/1953 Neumann ..... 60/587
2,671,297 A * 3/1954 Arms ..... 451/59
3,178,863 A * 4/1965 Mikiya ..... 451/505
3,496,685 A * 2/1970 Erich ..... 451/505
4,897,968 A * 2/1990 Hutt ..... 451/505
5,351,447 A * 10/1994 Grauert ..... 451/505
5,672,096 A * 9/1997 Amarosa et al. ..... 451/504

(Continued)

FOREIGN PATENT DOCUMENTS

AU 199053687 A1 10/1990

(Continued)

OTHER PUBLICATIONS

International Search Report for PCT Application No. PCT/AU2004/001269.

(Continued)

*Primary Examiner*—Jason R Bellinger
(74) *Attorney, Agent, or Firm*—Sheridan Ross PC

(57) ABSTRACT

A wheel assembly includes a first hub assembly sealingly engageable with a first axial opening in one side of a tire. A second hub assembly is sealingly engageable with a second axial opening on the other side of the tire. The hub assemblies define between them a fluid tight volume within the tire. The wheel further includes a valve having an inlet port in fluid communication with the tire, a valve seat, and at least one annular valve member resiliently biased into unidirectional sealing engagement with the seat. Application of external pressure through the inlet port causes at least a portion of the valve member to resiliently deflect away from the valve seat to thereby open the valve and permit fluid communication with the fluid tight volume.

20 Claims, 9 Drawing Sheets

U.S. PATENT DOCUMENTS

| | | | | |
|---|---|---|---|---|
| 6,685,547 | B2 * | 2/2004 | Boman | 451/495 |
| 2002/0004363 | A1 | 1/2002 | Boman | |

FOREIGN PATENT DOCUMENTS

| | | | |
|---|---|---|---|
| DE | 3431670 | A1 | 3/1985 |
| SE | 512682 | | 5/2000 |
| WO | 88/02679 | | 4/1988 |

OTHER PUBLICATIONS

Supplementary European Search Report for European Patent Application No. 04761304.7, mailed May 14, 2008.

Australian Patent Office International-Type Search Report for corresponding Australian Patent Application No. 2003905140 mailed Jan. 21, 2004.

* cited by examiner

WHEEL ASSEMBLY FOR A PNEUMATIC SANDER

FIELD OF THE INVENTION

The present invention relates to wheels for pneumatic sanders. It has been developed primarily for use as a pneumatic mounting wheel for an abrasive strip and will be described hereinafter with reference to this application. However, it will be appreciated that the invention is not limited to this particular field of use.

BACKGROUND OF THE INVENTION

The following discussion of the prior art is intended to present the invention in an appropriate technical context and allow its significance to be properly appreciated. Unless clearly indicated to the contrary, however, reference to any prior art in this specification should not be construed as an admission that such art is widely known or forms part of common general knowledge in the field.

Pneumatic wheel sanders are well known. Typically, the tire of these sanders include a valve similar to those used in motor vehicle tires. The valve is either positioned axially on the wheel or is alternatively offset from the wheel axis. If positioned axially, the valve does not affect the balance of the tire. However, complicated wheel configurations not inherently suitable for mass production are often required with axially located valves. On the other hand, if the valve is offset, it tends to cause excessive wheel vibration when rotated at high speed, particularly where tires with diameters of greater than 4 inches are used.

Prior art pneumatic sanding wheels also often include a central hub having an internal female thread at one axial end thereof for engagement with a male thread on an external drive shaft. Accordingly, in order for the wheel to be connected to a drive shaft having a male thread of differing diameter to that of the female thread of the wheel, a thread adapter is required between the wheel and the drive shaft. The provision of the adapter increases the cantilevering effect of the wheel from the drive shaft and therefore exaggerates any wheel inertia and vibration effects.

It is an object of the present invention to overcome or ameliorate at least one of the disadvantages of the prior art, or to provide a useful alternative.

DISCLOSURE OF THE INVENTION

According to a first aspect of the invention, there is provided a wheel having an inflatable tire for releasable pressure engagement with an abrasive belt, the wheel including:

- a first hub assembly sealingly engageable with a first axial opening in one side of the tire;
- a second hub assembly sealingly engageable with a second axial opening on the other side of the tire, the hub assemblies defining between them a fluid tight volume within the tire; and
- a valve including:
  - an inlet port in fluid communication with the tire;
  - a valve seat; and at least one annular valve member resiliently biased into unidirectional sealing engagement with the seat, such that application of external pressure through the inlet port causes at least a portion of the valve member to resiliently deflect away from the valve seat to thereby open the valve and permit fluid communication with the fluid tight volume.

Preferably, the valve member is substantially formed of an elastomeric material. Preferably, the wheel includes an annular valve chamber for housing the valve member. More preferably, the inlet port extends into the chamber. Preferably, the inlet port has a tapered opening. Preferably, the hub assemblies include central apertures. More preferably, the wheel includes a wheel hub extending through the central apertures, the wheel hub having a central bore.

In one preferred embodiment, each hub assembly includes a sealing cap having a peripheral rim sealingly engageable with its respective opening in the tire. Preferably, the wheel includes load transfer means engageable with the tire the arrangement being such that as the hub assemblies are moved into and out of sealing engagement with their respective openings, an annular sealing portion of the tire is compressed between the peripheral rim of the sealing cap and the load transfer means. Preferably, the load transfer means includes first and second spacer collars mounted within the tire. More preferably, the spacer collars are generally identically shaped. More preferably, the spacer collars are generally concave shaped. Preferably, each spacer collar includes a central aperture. Preferably, the spacer collars abut each other adjacent the central apertures such that each concave face is directed towards its respective axial opening in the tire.

Preferably, the sealing portion of the tire is compressed between the peripheral rim of the sealing cap and a peripheral rim of the respective spacer collar. More preferably, the wheel includes first and second hub collars respectively disposed outwardly of each sealing cap and relatively axially movable toward and away from each other respectively to bring the sealing cap rims into and out of sealing engagement with their respective openings in the tire. Preferably, the wheel hub extends axially through both the hub collars and both the spacer collars, the wheel hub having a flange at one end engageable with an outer face of the first hub collar and having an outer male threaded portion at its distal end. More preferably, the outer nut is threadably engageable with the distal male threaded portion outwardly of the second hub collar such that tightening or loosening the nut respectively moves the hub collars toward or away from each other to bring the cap rims into and out of sealing engagement with their respective openings.

Preferably, the wheel includes a mounting shaft receivable within the bore and fixedly engageable with a drive shaft to rotate the wheel. Preferably, the mounting shaft is engaged with the wheel by a frictional force. Alternatively, the mounting shaft is keyed into the hub. Alternatively, the mounting shaft is threadingly engagable with the hub bore.

Preferably, the wheel includes a washer slidably mounted on the hub, the washer being engageable with an internal edge of the sealing cap of the first hub assembly. More preferably, the wheel includes a radially extending groove on a face engageable with the internal edge of the sealing cap of the first hub assembly, the groove being disposed to direct fluid flowing from the duct into the volume. Preferably, the hub has an outer male threaded portion intermediate its ends and a retaining nut threadably engageable with the intermediate male threaded portion such that tightening the retaining nut compresses the washer, sealing cap and first hub collar against the flange. More preferably, the intermediate male threaded portion includes a thread of greater diameter and opposite hand to the distal male threaded portion. Preferably, the wheel includes a first fluid tight hub seal located between the second hub collar and the sealing cap of the second hub assembly.

Preferably, the wheel includes a second fluid tight hub seal located between the first hub collar and the sealing cap of the first hub assembly. More preferably, each fluid tight hub seal assembly includes at least one resilient annular sealing member. More preferably, the annular sealing member is in the form of an O-ring. Preferably, the valve member is in the form of an O-ring and is biased radially outwardly into sealing engagement with the valve seat. Preferably, the hub collars include a chamfered edge to facilitate engagement with the face of the sealing caps. Preferably, the annular chamber is defined by respective walls of the flange, hub and first hub collar. More preferably, the annular chamber is triangular in cross-section taken transverse to its circumference. Preferably, the inlet port extends through the flange into the annular chamber. Preferably, the wheel includes a duct extending from the annular chamber into the volume. More preferably, the duct is defined by a groove in an outer surface of the hub.

In another preferred embodiment, the inlet port is defined by a generally radial bore in the first hub collar. Preferably, the annular chamber is defined by an annular groove in the first hub collar. More preferably, the walls of the groove converge to a point to define a circumferential valve seat. Preferably, the valve member is resiliently biased axially into engagement with the valve seat. Preferably, the annual chamber extends from the inlet port to an axially opposite end of the first hub collar. More preferably, the valve member is in the form of a generally resilient annular ring. Alternatively, the valve member is in the form of an O-ring. Preferably, the valve member is compressed within the chamber to provide the resilient bias required to move the valve member into sealing engagement with the valve seat. Preferably, a duct extends from the annular chamber into the fluid tight volume. More preferably, the duct is defined by a groove in an outer surface of the hub.

In another preferred embodiment, the valve includes a valve member in the form of an annular skirt. Preferably, the skirt defines one the axial opening in the tire. Preferably, the application of external pressure causes at least a portion of the skirt to deflect resiliently radially inwardly to thereby open the valve. Preferably, the wheel includes a generally C-shaped sealing cap adapted to seal the second axial opening. More preferably, the aperture defining the valve inlet port is provided in the sealing cap. Preferably, the sealing cap fits around the skirt and seals against a sealing portion of the tire defined by a radially oriented annular rim between the skirt and a maximum outer diameter of the tire. Preferably, the wheel includes load transfer means disposed within the tire and extending between the first and second axial openings. More preferably, the load transfer means includes an annular flange engageable with the sealing portion of the tire. More preferably, the wheel includes a nut engageable with the sealing cap such that tightening the nut brings the sealing cap into sealing engagement with the sealing portion of the tire, sandwiching the sealing portion between the sealing cap and the annular flange of the load transfer means. Preferably, the wheel includes a cylindrical spacer extending between the load transfer means along an inner side of the skirt. More preferably, the spacer resiliently biases the skirt radially outwardly into sealing engagement with the sealing cap. Preferably, the wheel includes a mounting shaft extending from the first axial opening through the load transfer means and the sealing cap, the mounting shaft being adapted for connection to a drive shaft to rotate the wheel. More preferably, the mounting shaft includes an internal female threaded portion adapted for engagement with a complimentary male threaded portion on the drive shaft.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Figure 1:
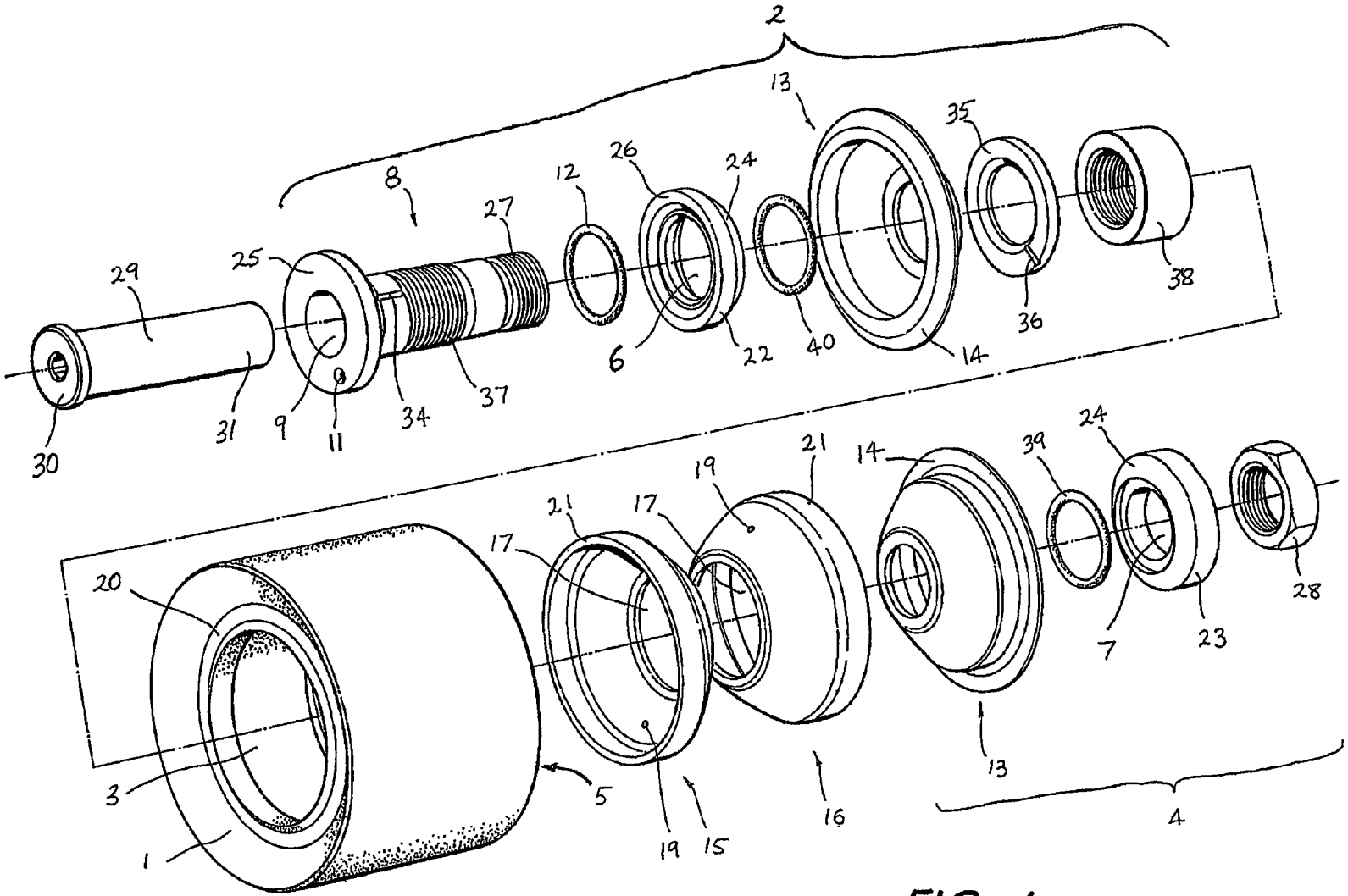
FIG. 1 is an exploded perspective view of a wheel according to a first embodiment of the invention.
Figure 2:
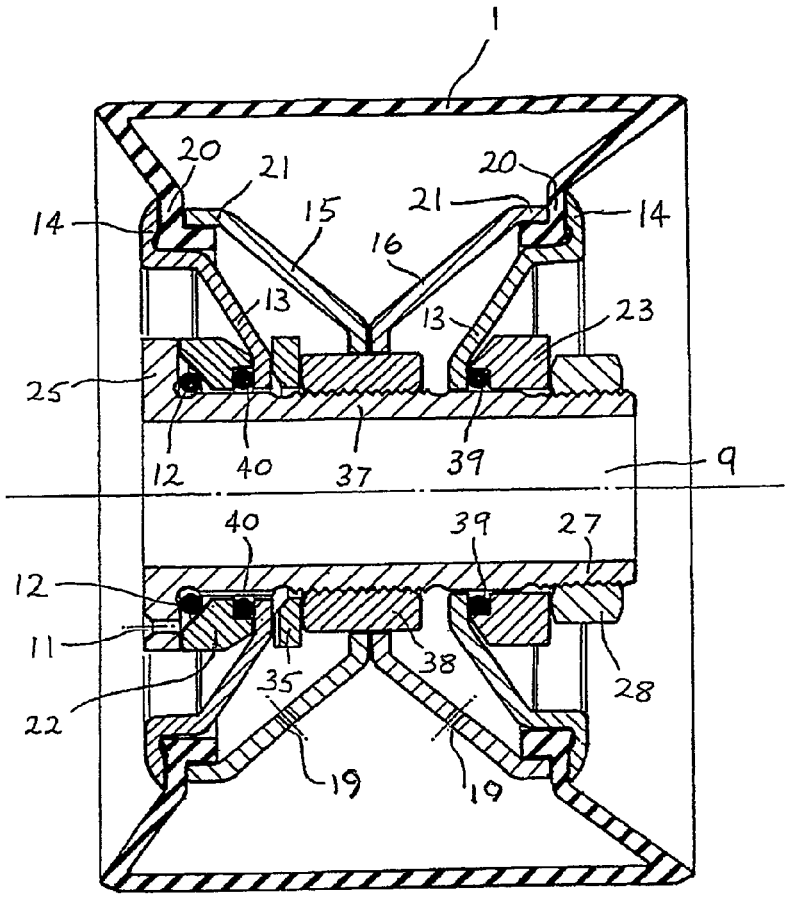
FIG. 2 is a sectional side view of the wheel of FIG. 1.

FIGS. 1 and 2 of the drawings show a first embodiment of the abrasive wheel, particularly suitable for wheel diameters greater than around 75 millimeters. The wheel includes an inflatable tire 1 for releasable pressure engagement with an abrasive belt (not shown). A first sealing hub assembly 2 is sealingly engageable with a first axial opening 3 in one side of the tire 1 and a second sealing hub assembly 4 is sealingly engageable with a second axial opening 5 on the other side of the tire to define a fluid tight volume within the tire. The first and second hub assemblies each include a central circular aperture, respectively 6 and 7. A wheel hub 8 having a longitudinally extending central bore 9 extends through the apertures. The wheel also includes a valve 10 for permitting selective movement of an inflation fluid into and out of the tire 1.

Figure 2A:
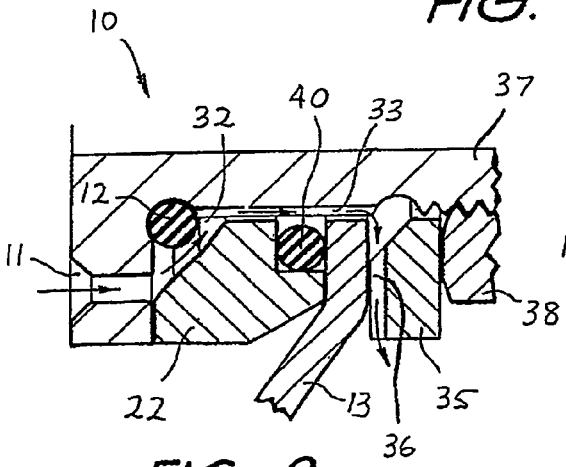
FIG. 2*a* is an enlarged sectional view of the inlet valve of the wheel, shown in an open configuration.

The valve 10 includes an inlet port 11 and an annular valve member in the form of an O-ring 12. As best seen in FIG. 2*a*, upon application of external pressure through the inlet port, at least a portion of the O-ring deflects resiliently radially inwardly, thereby opening the valve 10 and allowing the tire 1 to be inflated.

Each hub assembly 2 and 4 includes a sealing cap 13 having a peripheral rim 14 sealingly engageable with its respective opening 3 and 5 in the tire. Moreover, the wheel includes load transfer means in the form of first and second spacer collars 15 and 16 mounted within the tire. The spacer collars are generally concave-shaped and include a central aperture 17. A fluid communication aperture 19 is also included in the concave face of each spacer collar to facilitate fluid movement within the tire.

It will be appreciated that the first and second spacer collars 15 and 16 are substantially identical in shape and as such, save on manufacturing and assembly costs.

The spacer collars 15 and 16 abut each other adjacent the central aperture 17 such that their concave faces are directed towards the respective axial openings 3 and 5 in the tire. An annular sealing portion 20 of the tire is compressed between the peripheral rim 14 of the sealing cap and a peripheral sealing rim 21 of the respective spacer collar.

The wheel includes first and second hub collars 22 and 23 respectively disposed outwardly of each sealing cap 13 and relatively axially movable toward and away from each other respectively to bring the cap rims 14 into and out of sealing engagement with their respective openings in the tire. The hub collars 22 and 23 each include a chamfered edge 24 to facilitate engagement with the sealing caps 13.

The hub 8 axially extends through both the hub collars and both the spacer collars 15 and 16. The hub 8 includes a flange 25 at one end engageable with an outer face 26 of the first hub collar 22 and has an outer male threaded portion 27 at its distal end. An outer nut 28 is threadably engageable with the distal male threaded portion outwardly of the second hub collar 23 such that tightening or loosening the nut respectively moves the hub collars toward or away from each other to bring the cap rims into and out of sealing engagement with their respective tire openings.

In use, a mounting shaft 29 is slidably received within the hub bore 9. The mounting shaft includes a flange 30 at its proximal end engageable with the hub flange 25 and at its distal end 31 includes an internal female threaded portion engageable with a complementary male thread on a drive shaft (not shown).

The wheel also includes an annular valve chamber 32 defined by respective walls of the flange 25, hub 8 and first hub collar 22. The chamber is generally triangular in cross-section taken transverse to its circumference and also houses the O-ring 12.

The inlet port 11, which has a tapered opening, extends through the flange 25 and into the chamber 32. From the chamber, a duct 33 extends into the fluid tight volume. The duct 33 is partly defined by a groove 34 in an outer surface of the hub 8.

A washer 35 is slidably mounted on the hub 8 and is engageable with an internal edge of the cap 13 of the first hub assembly. The washer includes a radially extending groove 36 on a face engageable with the internal edge of the sealing cap 13. This groove 36 is disposed to direct fluid flowing from the duct 33 into the volume.

The hub 8 has an outer male intermediate threaded portion 37 and a retaining nut 38 threadably engageable with the intermediate threaded portion. Tightening the retaining nut 38 compresses the washer 35, cap 13 and first hub collar 22 against the hub flange 25. The intermediate male threaded portion 37 includes a thread of greater diameter and opposite hand to the distal male threaded portion 27.

A first hub seal in the form of an O-ring 39 is located between the second hub collar and the cap of the second hub assembly to prevent fluid escaping between these two components.

A second hub seal in the form of an O-ring 40 is located between the first hub collar and the sealing cap of the first hub assembly. The second hub seal prevents fluid escaping between the first hub collar and the sealing cap of the first hub assembly, particularly in the region adjacent the groove 36.

In use, to apply an abrasive belt to the wheel, the tire 1 is initially deflated. This is achieved by inserting a probe into the inlet port 11 and manually deforming the O-ring 12 radially inwardly out of sealing engagement with the valve chamber wall.

Figure 2B:
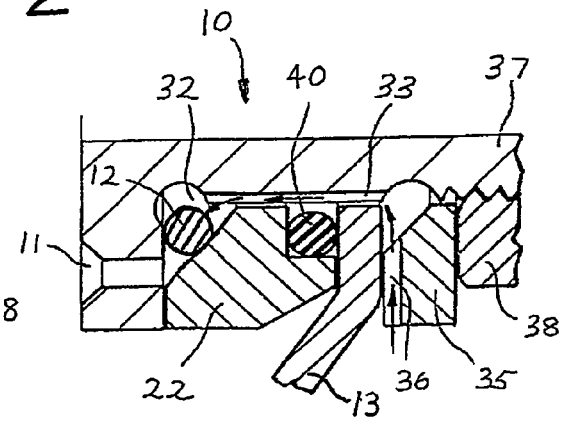
FIG. 2*b* is an enlarged sectional view of the inlet valve of the wheel, shown in a closed configuration.

Once the tire has been sufficiently deflated, the belt is placed circumferentially around the tire. The tire is then reinflated until its circumference has expanded sufficiently to secure the belt. In this embodiment this is achieved by injecting compressed air into the inlet port 11. The pressure of the compressed air causes the O-ring to deflect resiliently radially inwardly to open the valve, as shown in FIG. 2*a*. Once the application of compressed air is complete, the O-ring resiliently springs back into sealing engagement with the valve chamber wall to close the valve and seal the tire, as shown in FIG. 2*b*.

The wheel is secured to a drive shaft (not shown) by inserting the mounting shaft 29 through the hub bore 9 until the shaft flange 30 is engaged with the hub flange 25. The mounting shaft is then threadedly engaged with the drive shaft until sufficient compressive force is achieved between the shaft flange 30 and the end of the drive shaft to hold the wheel in place. In one alternative embodiment (not shown), the mounting shaft is keyed into the hub. In another alternative embodiment (not shown), the mounting shaft is omitted and the hub bore includes an inner female threaded portion at its distal end, the female thread being adapted for threaded engagement with a complementary male thread on a drive shaft.

Advantageously, the individual components of the wheel are well suited to mass production. The tire is suited for moulding from rubber, the hub, hub collars, spacer collars and washers from aluminium and the nuts from steel. Alternatively, the hub collars, spacer collars and washers are made from nylon or another suitable polymer to provide a more lightweight wheel.

It will be appreciated that the illustrated device, by virtue of the hub bore 9 and mounting shaft 29, is engageable with a complementary drive shaft closely adjacent the second hub assembly 4, regardless of the relative size of the female threaded portion on the wheel and the corresponding male threaded portion on the drive shaft. The wheel achieves this improvement by negating the requirement for a thread adapter between the wheel and the drive shaft as has been the case in prior art devices. Instead, a mounting shaft with a female threaded portion of complementary diameter of that of the drive shaft is selected to engage the wheel with the drive shaft without increasing the distance therebetween. Accordingly, the cantilevering effect caused by the need for a thread adapter in prior art devices is reduced and as a result, wheel vibration and inertial problems are reduced, making the device suitable for hand-held applications.

The valve arrangement described, also improves performance by allowing an almost symmetrical mass distribution about the axis of rotation and accordingly reducing wheel vibration without requiring complicated wheel balancing. It will also be appreciated that the individual components of the valve 10 are well suited to mass production. The embodiment illustrated in FIGS. 1 to 2 also provides the additional advantage of having no protruding parts and accordingly the risk of operator injury is reduced. In all of these respects, the illustrated embodiment of the invention represents a practical and commercially significant improvement over the prior art.

Figure 3:
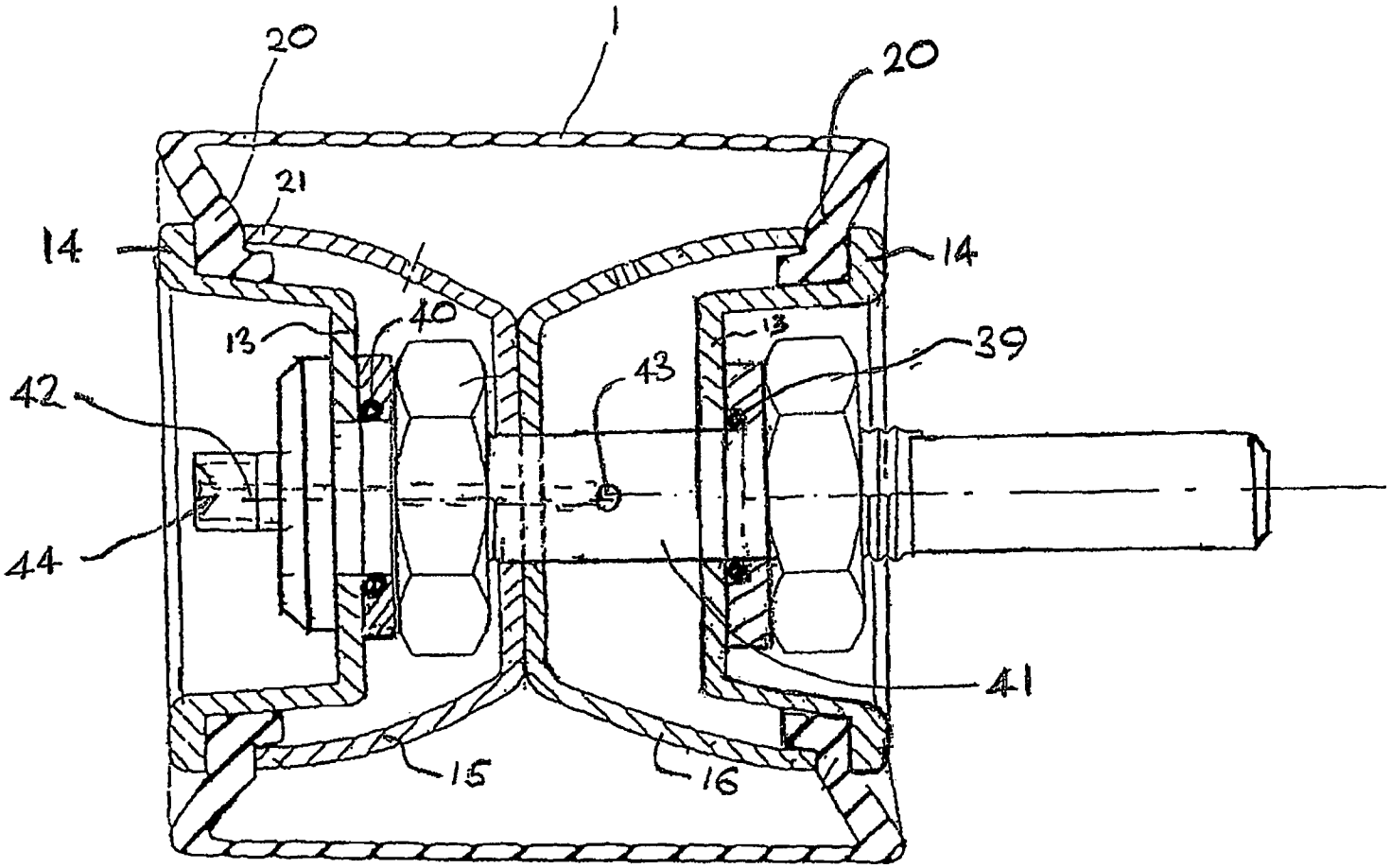
FIG. 3 is a sectional view of an alternative embodiment of the wheel.

An alternative embodiment of the wheel is illustrated in FIG. 3, where corresponding reference numerals denote corresponding features as described above. However, this embodiment differs from the first embodiment in that the wheel hub 8 and mounting shaft 29 have been replaced by a universal shaft 41, which in a similar way to the first embodiment, is adapted to be driven by a drive shaft. Universal shaft 41 includes an axial valve chamber 42, which communicates to the fluid tight volume via a radial bore 43 extending between the valve chamber and the shaft periphery. The valve chamber 41 has a female threaded portion 44 at its proximal end to allow a standard valve fitting (not shown) to be threadingly engaged to the proximal end of the shaft 41.

It will be appreciated that the embodiment illustrated in FIG. 3, provides an abrasive wheel with improved wheel performance due to an almost perfect symmetrical mass distribution about the axis of rotation to thereby reduce wheel vibration, without requiring complicated wheel balancing.

Figure 4:
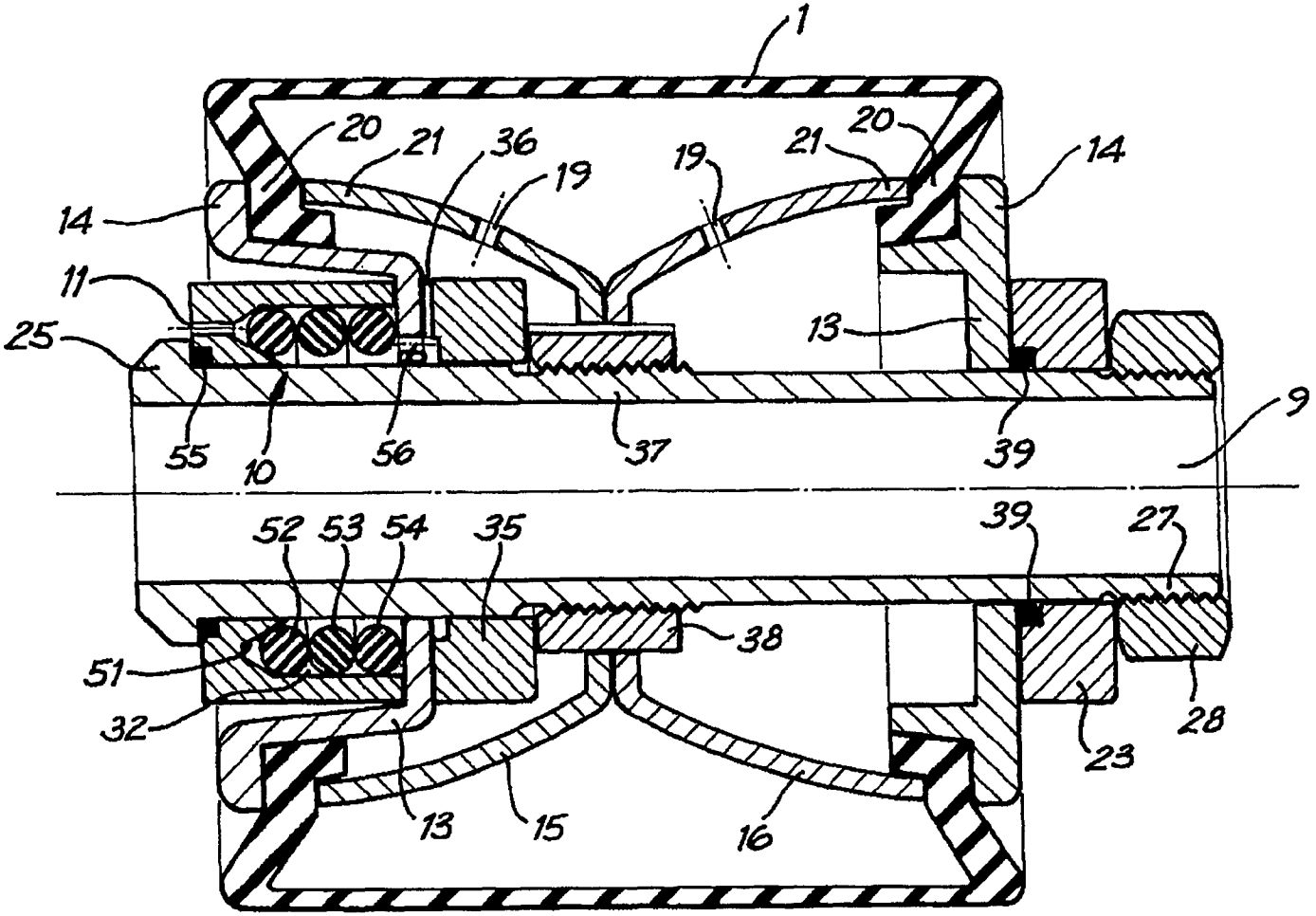
FIG. 4 is a sectional view of a wheel according to another embodiment of the invention similar to that shown in FIGS. 1 to 2*a;*

Another embodiment of the abrasive wheel is illustrated in FIG. 4. This embodiment is also similar to that illustrated in FIGS. 1 to 2*b*, where corresponding reference numerals denote corresponding features.

In this embodiment, a first hub collar 50, different to the first hub collar of the embodiment shown in FIGS. 1 to 2*b*, is provided. The hub collar 50 is adapted to be engaged around the hub 8 between the hub flange 25 and the sealing cap 13 of the first hub assembly. The valve 10 is formed within the first hub collar 50. The valve includes an inlet port 11 and also a valve chamber 32 in the form of an annular chamber extending from the inlet port to an axially opposite side of the first hub collar. The valve chamber tapers inwardly at its end adjacent the inlet port, thereby to define an annular valve seat 51. The valve chamber houses a valve member in the form of a first O-ring 52. The O-ring is resiliently biased axially outwardly into engagement with the valve seat 51 to close the valve. The valve chamber also includes second 53 and third 54 O-rings spaced axially inwardly of the first O-ring.

The inner diameter of all three O-rings is greater than the inner diameter of the annular valve chamber such that a clearance space is provided between the O-rings and the inner wall of the valve chamber. The sum of the thicknesses of the O-rings is greater than the length of the valve chamber such that when the first hub collar is compressed between the mounting shaft flange and the sealing cap of the first hub assembly, the three O-rings are compressed together in the valve chamber, thereby to resiliently bias the first O-ring into sealing engagement with the valve seat 51.

An additional O-ring seal 55 is provided between the first hub collar 50 and the hub 8, adjacent the hub flange, to prevent fluid within the tire 1 escaping from between these components.

To open the valve of the tire shown in FIG. 4, the first O-ring 52 is compressed axially inwardly towards the centre of the tire and out of sealing engagement with the valve seat 51. The movement of the first O-ring can be effected either by directing compressed air through the inlet port 11 or by inserting a probe into the inlet port and manually moving the first O-ring 52. The compressive force applied to the first O-ring is transferred to the second O-ring 53, which results in the second O-ring being compressed between the first 52 and third 54 O-rings, which in turn causes the second O-ring 53 to slide radially inwardly between the first and third O-rings and thereby to allow the first O-ring to more freely move out of sealing engagement with the valve seat 51. It will be appreciated that friction between the three O-rings can be reduced to facilitate sliding of the O-rings by the application of a suitable lubricant.

Once the valve is opened, fluid injected through the inlet port passes through the valve chamber 32, past the first, second and third O-rings, through a port 56 in the sealing cap of the first hub assembly, along the groove 36 in the washer 35 and into the fluid tire via apertures 19 in the spacer collars 15 and 16.

It will be appreciated that a resilient rubber sleeve (not shown) may replace one, two or all of O-rings 52-52.

Figure 5:
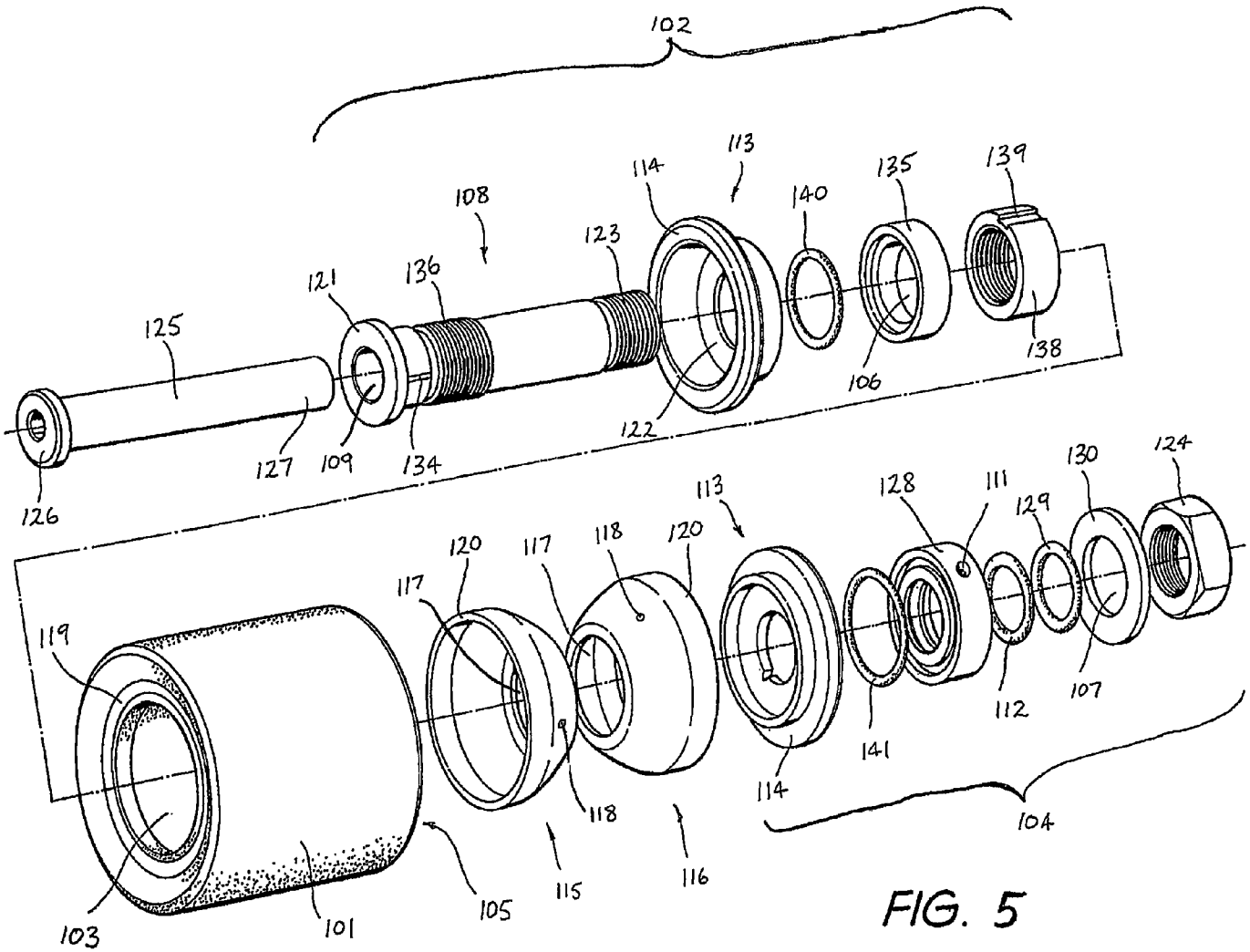
FIG. 5 is an exploded perspective view of another embodiment of a wheel according to the invention.
Figure 6:
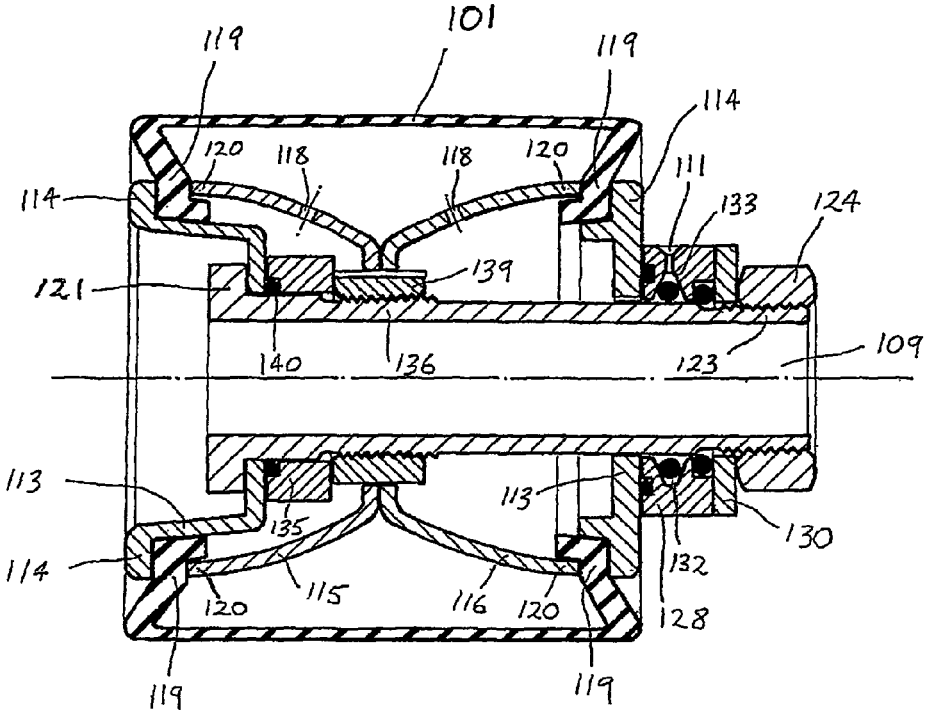
FIG. 6 is a sectional side view of the wheel of FIG. 5.
Figure 6A:
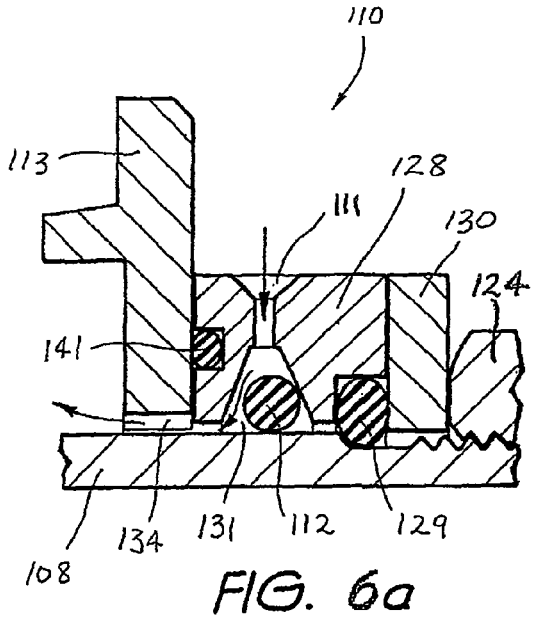
FIG. 6*a* is an enlarged sectional view of the inlet valve of the wheel of FIG. 5, shown in an open configuration.
Figure 6B:
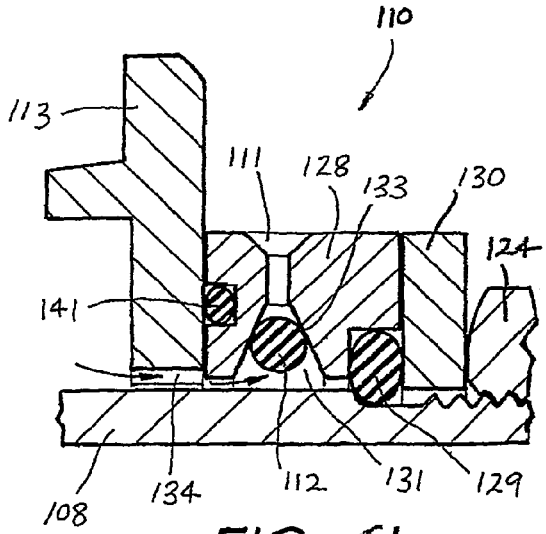
FIG. 6*b* is an enlarged sectional view of the inlet valve of the wheel of FIG. 5, shown in a closed configuration.

FIGS. 5 to 6*b* show another embodiment of the abrasive wheel, also particularly suitable for wheel diameters greater than around 75 millimeters. The wheel includes an inflatable tire 101 for releasable pressure engagement with an abrasive belt (not shown). A first sealing hub assembly 102 is sealingly engageable with a first axial opening 103 in one side of the tire 101 and a second sealing hub assembly 104 is sealingly engageable with a second axial opening 105 on the other side of the tire to define a fluid tight volume within the tire. The first and second hub assemblies each include a central circular aperture, respectively 106 and 107. A wheel hub 108 having a longitudinally extending central bore 109 extends through the apertures. The wheel also includes a valve 110 for permitting selective movement of fluid into and out of the tire 101.

The valve includes an inlet port 111 and an annular valve member in the form of an O-ring 112. As best seen in FIG. 6*a*, upon application of external pressure through the inlet port, at least a portion of the O-ring deflects resiliently radially inwardly, thereby opening the valve 110 and allowing the tire 101 to be inflated.

Each hub assembly 102 and 104 includes a sealing cap 113 having a peripheral rim 114 sealingly engageable with its respective opening 103 and 105 in the tire. Moreover, the wheel includes load transfer means in the form of substantially identical first and second spacer collars 115 and 116 mounted within the tire. The spacer collars are generally concave-shaped and include a central aperture 117. A fluid communication aperture 118 is also included in the concave face of each spacer collar to facilitate fluid movement within the tire.

The spacer collars 115 and 116 abut each other adjacent the central aperture 117, such that their concave faces are directed towards the respective axial openings 103 and 105 in the tire. An annular sealing portion 119 of the tire is compressed between the peripheral rim 114 of the sealing cap and a peripheral sealing rim 120 of the respective spacer collar.

The hub 108 extends axially through both the sealing caps and both the spacer collars. The hub 108 includes a flange 121 at its proximal end engageable with an outer face 122 of the sealing cap 113 of the first hub assembly and has an outer male threaded portion 123 at its distal end. An outer nut 124 is threadably engageable with the distal male threaded portion outwardly of the sealing cap 113 of the second hub assembly, such that tightening or loosening the nut respectively moves the sealing caps toward or away from each other to bring the cap rims 114 into and out of sealing engagement with their respective tire openings.

A mounting shaft 125 is slidably received within the hub bore 109. The mounting shaft includes a flange 126 at its proximal end engageable with the hub flange 121, and at its distal end 127 includes an internal female threaded portion engageable with a complementary male thread on a drive shaft (not shown).

The wheel includes a hub collar 128 slidably mounted around the hub 108 between the sealing cap 113 of the second hub assembly and outer nut. A fluid tight O-ring seal including an O-ring 129 and a washer 130 is provided around the hub between the hub collar 128 and the outer nut 124.

The valve inlet port 111 having a tapered entry, is defined by a generally radial bore in the hub collar 128. The inlet port extends into a valve chamber 131 housing the valve member O-ring 112. The valve chamber is defined by a circumferential groove 132 extending around a radially inner wall of the hub collar 128. The walls of the groove converge to a point to define a circumferential valve seat 133. A duct 134 defined by a groove in the outer surface of the hub extends from the valve chamber 131 into the fluid tight volume.

A washer 135 is slidably mounted on a proximal end of the hub 108 and is engageable with an internal edge of the sealing cap 113 of the first hub assembly. The hub 108 has an outer male intermediate threaded portion 136 and a retaining nut 138, which is threadably engageable with the intermediate threaded portion. The retaining nut includes a notch 139 adapted for engagement with a complementary spanner to facilitate tightening. The intermediate male threaded portion 136 includes a thread of greater diameter and opposite hand to the distal male threaded portion 123. An O-ring seal 140 is provided between the washer 136 and the sealing cap 113 of the first hub assembly, such that tightening the retaining nut 138 compresses the washer and cap against the sealing cap to form a fluid tight seal.

Another O-ring seal 141 is provided around the hub between the sealing cap of the second hub assembly and the hub collar to prevent fluid escaping between these two components.

In use, to apply an abrasive belt to the wheel, the tire 1 is initially deflated. In the embodiment illustrated in FIGS. 5 to 6*b*, this is achieved by inserting a probe into the inlet port 111 and manually deforming the valve member O-ring 112 radially inwardly out of sealing engagement with the valve seat 133.

Once the tire has been sufficiently deflated, the belt is placed circumferentially around the tire. The tire is then reinflated until its circumference has expanded sufficiently to secure the belt. In the embodiment illustrated in FIGS. 5 to 6*b*, this is achieved by injecting compressed air into the inlet port 111. The pressure of the compressed air causes the valve member O-ring to deflect resiliently radially inwardly to open the valve, as shown in FIG. 6*a* Once the application of compressed air is complete, the O-ring resiliently springs back into sealing engagement with the valve chamber wall to close the valve and seal the tire, as shown in FIG. 6*b*.

The wheel is secured to a drive shaft by inserting the mounting shaft 125 through the hub bore 109 until the shaft flange 126 is engaged with the hub flange 121. The mounting shaft is then threadedly engaged with the drive shaft until sufficient compressive force is achieved between the mounting shaft flange 126 and the end of the drive shaft to hold the wheel in place. In one alternative embodiment (not shown), the mounting shaft is keyed into the hub. In another alternative embodiment (not shown), the mounting shaft is omitted and the hub bore includes an inner female threaded portion at its distal end, the female thread being adapted for threaded engagement with a complementary male thread on a drive shaft.

Figure 7:
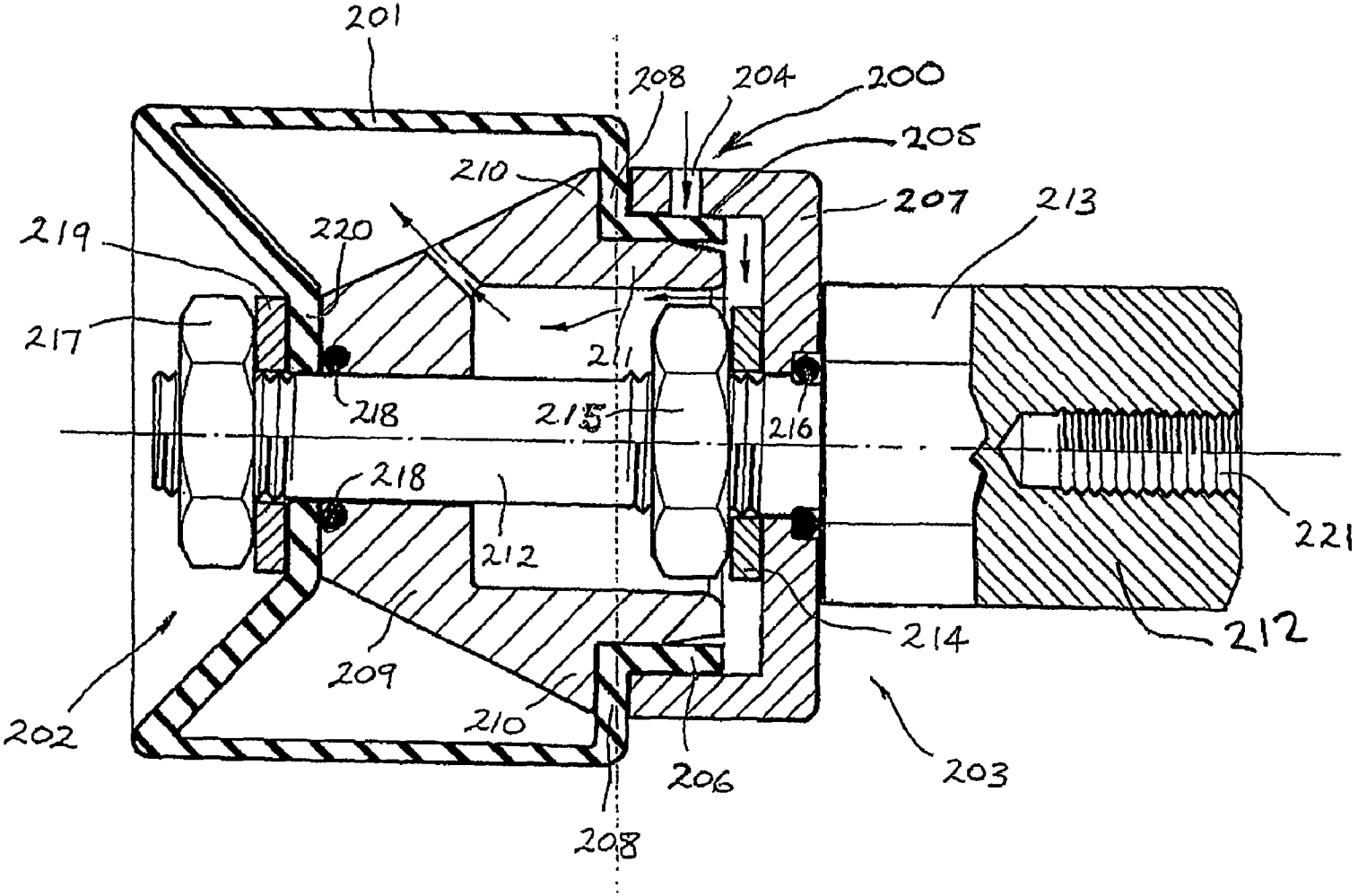
FIG. 7 is a sectional view of a wheel according to yet another embodiment of the invention.

Another embodiment of the abrasive wheel is shown in FIG. 7. This embodiment is particularly suited for smaller wheel diameters, such as from around 75 millimeters down to around 25 millimeters. The wheel includes an inflatable tire 201 for releasable pressure engagement with an abrasive belt (not shown). A first sealing hub assembly 202 is sealingly engageable with a first axial opening in one side of the tire 201 and a second sealing hub assembly 203 is sealingly engageable with a second axial opening on the other side of the tire to define a fluid tight volume within the tire. The wheel also includes a valve 200 defined by an inlet port 204 in fluid communication with the tire, a valve seat 205 and an annular valve member 206 resiliently biased radially outwardly into unidirectional sealing engagement with the seat 205. The valve member 206 is configured such that application of external pressure through the inlet port 204 causes at least a portion of the valve member to deflect resiliently radially inwardly, thereby to open the valve. In this embodiment, the valve member takes the form of an annular skirt 206 defining the second axial opening 203 in the tire.

An annular sealing cap 207, generally C-shaped in diametrical cross-section, seals the second axial opening. The cap fits snugly around the skirt 206 and seals against a sealing portion 208 of the tire defined by a radially extending annular rim between the skirt and the maximum outer diameter of the tire. The sealing cap 207 also includes an aperture 204 defining the valve inlet port.

A load transfer core 209 is disposed within the tire and extends between the first and second axial openings. The core includes an annular flange 210 engageable with the sealing portion 208 of the tire. A cylindrical spacer 211 extends from the core 209 along an inner side of the skirt 206. In this embodiment, the spacer is formed integrally with the core and biases the skirt 206 radially outwardly into sealing engagement with the sealing cap 207.

In use, the wheel is mounted on a mounting shaft 212 extending from the first axial opening through the core 209 and the sealing cap 207. The mounting shaft includes a boss 213 at one end having an inner face oriented perpendicularly to the axis of rotation of the wheel. The sealing cap 207 is mounted on the shaft 212 and abuts the inner face of the boss 213, thereby ensuring correct alignment and optimising wheel balance. A washer 214 is positioned inwardly of the sealing cap and an inner nut 215 is provided inwardly of the washer. An O-ring seal 216 is provided between the sealing cap 207 and the boss 213. Tightening an inner nut 215 compresses the washer 214 and sealing cap 207 tightly together against the boss 213.

At the other end, the mounting shaft 212 includes an outer retaining nut 217, O-ring 218 and washer 219. Tightening of this outer retaining nut 217 compresses the sealing portion 208 of the tire between the annular flange 210 of the core and the sealing cap 207 to seal the second axial opening and at the same time compresses another sealing portion 220 of the tire between the washer 219 and the core 209 to seal the first axial opening. It will be appreciated that in alternative embodiments the O-ring 216 may be replaced by a suitable sealing compound, such as that known commercially as "Lock-Tite".

The mounting shaft 212 includes a female threaded portion 221 at one end to allow the wheel to be coupled to a complementary male thread on a drive shaft (not shown). However, it will be appreciated that in alternative embodiments the threaded portion may be replaced by a chuck, or any other suitable form of mechanical connector known in the art, to secure the wheel to the drive shaft.

Figure 8:
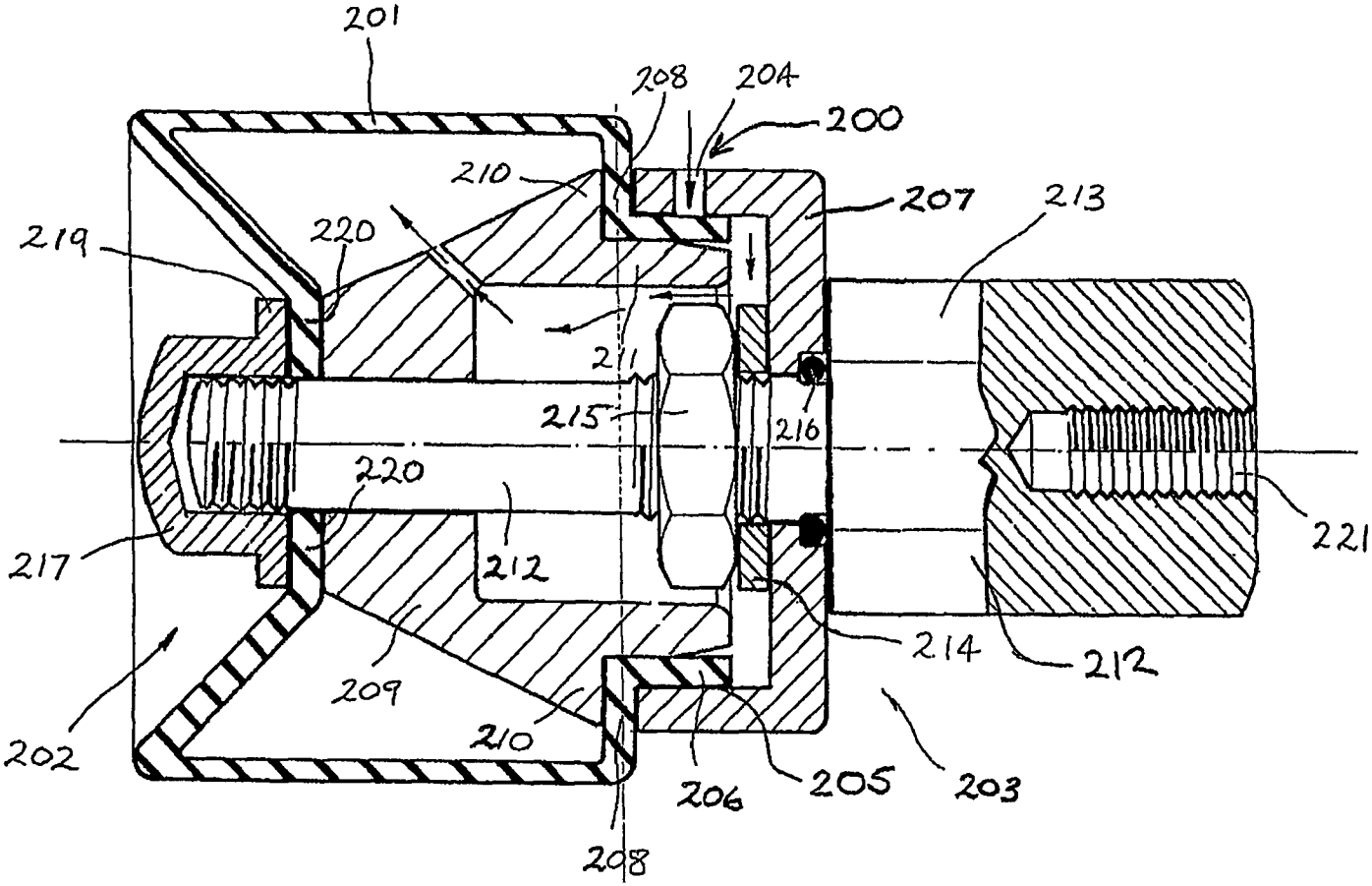
FIG. 8 is a sectional view of a wheel according to yet another embodiment of the invention similar to that shown in FIG. 7.

An alternate embodiment of the abrasive wheel is illustrated in FIG. 8. This embodiment is similar to that illustrated in FIG. 7, where corresponding reference numerals denote corresponding features. However, in the embodiment shown in FIG, 8, the outer retaining nut 217 takes the form of a dome nut and the O-ring 218 is omitted, as the dome nut provides an adequate seal for the first axial opening.

Figure 9:
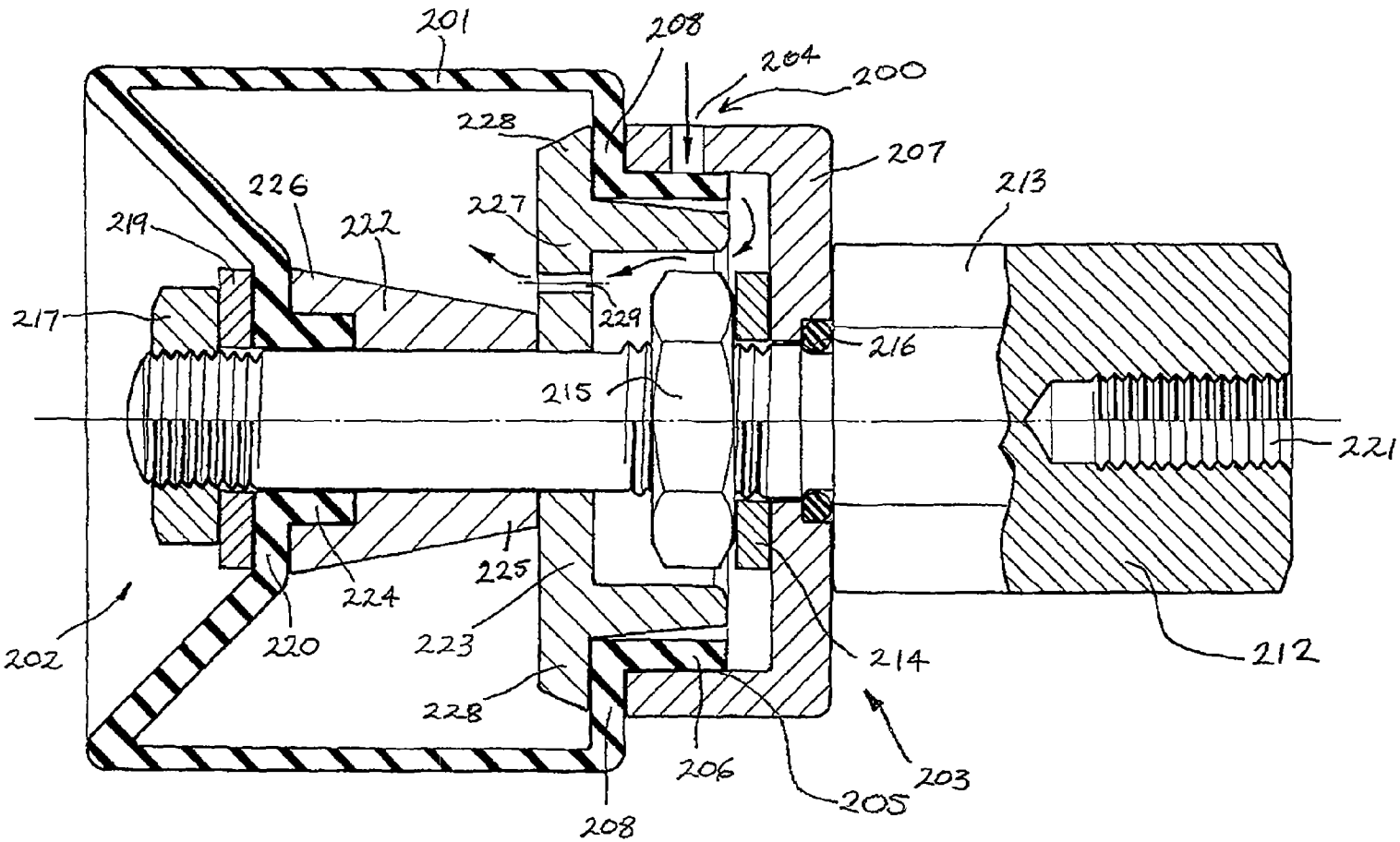
FIG. 9 is a sectional view of a wheel according to yet another embodiment of the invention, similar to those shown in FIGS. 7 and 8.

Another alternative embodiment is illustrated in FIG. 9. This embodiment is similar to those illustrated in FIGS. 7 and 8, where corresponding reference numerals denote corresponding features.

In the embodiment shown in FIG. 9, a two-piece load transfer core comprising a first part 222 and a second part 223, replaces the one-piece load transfer core used in the earlier embodiments illustrated in FIGS. 7 and 8. In addition, the sealing portion 220 includes an axially inwardly directed skirt 224 defining cylindrical sleeved portion adapted in use to fit snugly around the mounting shaft 212. The first part 222 is substantially conical, is truncated at one end 225, and includes an axial bore for receiving the mounting shaft 212. The other end 226 of the first part 222 includes an annular recess adapted in use to receive the skirt 224, such that in use the washer 219, sealing portion 220, skirt 224 and first part 222 are axially compressed into sealing engagement.

The second part 223 takes the form of a plug adapted to seal the opening in the tire defined by the annular skirt 206. The plug includes a disc shaped head 227 having a diameter greater than the diameter of the annular skirt 206, such that in use the sealing portion 208 is compressed between the sealing cap 207 and an outer portion 228 of the head 227. The valve seat 205 takes the form of a circumferential inner surface formed integrally with and extending axially from the sealing cap 207. A radially outer surface of the tubular portion extending from the head 227 tapers inwardly such that diameter of the tubular portion adjacent the head is greater than the diameter at its terminal end. In this way, sufficient space is provided inwardly of the annular skirt 206 to allow the skirt resiliently to deflect inwardly when compressed air is directed through inlet port 204 to open the valve. The head of the second part is also provided with an aperture 229 to allow air injected through the inlet port 204 to flow freely into the tire.

In use, to apply an abrasive belt to any one of the wheels illustrated in FIGS. 7 to 9, the tire 201 is initially deflated. This deflation achieved by inserting a probe into the inlet port 209 and manually deforming the annular valve member skirt 206 radially inwardly out of sealing engagement with the valve seat 205.

Once the tire has been sufficiently deflated, the belt is placed circumferentially around the tire. The tire is then reinflated until its circumference has expanded sufficiently to secure the belt. This is achieved by injecting compressed air into the inlet port 204. The pressure of the compressed air causes the valve member skirt to deflect resiliently radially inwardly to open the valve. Once the application of compressed air is complete, the skirt resiliently springs back into sealing engagement with the valve seat to close the valve and seal the tire.

The individual components of the wheel are well suited to mass production. The tire is suited for moulding from rubber, the mounting shaft, sealing cap and nuts from steel and the load transfer core from nylon or another suitable relatively heavy duty polymer.

It will be appreciated that the valve arrangements described with reference to FIGS. 7 to 9, provide an almost symmetrical mass distribution about the axis of rotation and accordingly reduce wheel vibration without requiring complicated wheel balancing. It will also be appreciated that the individual components of the valve are well suited to mass production. The embodiments illustrated in FIGS. 7 to 9 also provide the additional advantage of having no protruding parts and accordingly the risk of operator injury is reduced. Additionally, the tire of the illustrated sanding wheels is also easily changeable. To change the tire, nut 217 is unscrewed and the tire and core are simply slid from the mounting shaft. In all these respects, this embodiment also represents a practical and commercially significant improvement over the prior art.

Although the invention has been described with reference to specific examples, it will be appreciated by those skilled in the art that the invention may be embodied in many other forms.

The invention claimed is:

1. A wheel assembly for a pneumatic sander comprising:

an inflatable tire for releasable pressure engagement with an abrasive belt;

a first hub assembly sealingly engageable with a first axial opening in one side of said tire;

a second hub assembly sealingly engageable with a second axial opening on the other side of said tire, said hub assemblies defining between them a fluid tight volume within said tire; and a valve including:

an inlet port in fluid communication with said tire;

a valve seat;

at least one annular valve member formed from a part of said tire, said part being a skirt resiliently biased into unidirectional sealing engagement with said seat, such that application of external pressure through said inlet port causes at least a portion of said valve member to resiliently deflect away from said valve seat to thereby open said valve and permit fluid communication with said fluid tight volume; and load transfer means engageable with said tire, wherein as said hub assemblies are moved into and out of sealing engagement with their respective openings, an annular sealing portion of said tire is compressed between the peripheral rim of a sealing cap and said load transfer means.

2. A wheel according to claim 1, wherein said valve member is substantially formed of an elastomeric material.

3. A wheel according to claim 1, wherein said inlet port extends into an annular valve chamber.

4. A wheel according to claim 3, wherein said inlet port extends into said annular valve chamber.

5. A wheel according to claim 1, wherein said hub assemblies include central apertures.

6. A wheel according to claim 1, wherein each hub assembly includes a sealing cap having a peripheral rim sealingly engageable with its respective opening in said tire.

7. A wheel according to claim 1, wherein said load transfer means includes first and second spacer collars mounted within said tire.

8. A wheel according to claim 4 including a duct extending from said annular valve chamber into said fluid tight volume.

9. A wheel according to claim 1, wherein said skirt defines one said axial opening in said tire.

10. A wheel according to claim 1, wherein application of external pressure causes at least a portion of the skirt to deflect resiliently radially inwardly to thereby open said valve.

11. A wheel according to claim 1 including a generally C-shaped sealing cap adapted to seal the second axial opening.

12. A wheel according to claim 11, wherein an aperture defining said valve inlet port is provided in said sealing cap.

13. A wheel according to claim 11, wherein said sealing cap fits around said skirt and seals against a sealing portion of said tire defined by a radially oriented annular rim between said skirt and a maximum outer diameter of said tire.

14. A wheel according to claim 1 including load transfer means disposed within said tire and extending between said first and second axial openings.

15. A wheel according to claim 14, wherein said load transfer means includes an annular flange engageable with the sealing portion of said tire.

16. A wheel according to claim 15 including a nut engageable with a sealing cap such that tightening said nut brings said sealing cap into sealing engagement with the sealing portion of said tire, sandwiching the sealing portion between said sealing cap and said annular flange of said load transfer means.

17. A wheel according to claim 14 including a cylindrical spacer extending between said load transfer means along an inner side of said skirt.

18. A wheel according to claim 17, wherein said spacer resiliently biases said skirt radially outwardly into sealing engagement with said sealing cap.

19. A wheel according to claim 16 including a mounting shaft extending from said first axial opening through said load transfer means and said sealing cap, said mounting shaft being adapted for connection to a drive shaft to rotate said wheel.

20. A wheel according to claim 19, wherein said mounting shaft includes an internal female threaded portion adapted for engagement with a complimentary male threaded portion on said drive shaft.

* * * * *